US005149564A

United States Patent [19]

Kato et al.

[11] Patent Number: 5,149,564

[45] Date of Patent: Sep. 22, 1992

[54] METHOD OF FORMING LURICATING FILM AND A METHOD OF PREPARING MAGNETIC RECORDING MEDIUM

[75] Inventors: Atsushi Kato, Hiratsuka; Waichi Nagashiro, Kanagawa; Motoo Akagi, Tokyo, all of Japan

[73] Assignee: Hitachi, Ltd., Tokyo, Japan

[21] Appl. No.: 659,689

[22] Filed: Feb. 25, 1991

[30] Foreign Application Priority Data

Mar. 16, 1990 [JP] Japan ..... 2-064047

[51] Int. Cl.[5] ..... B05D 5/12

[52] U.S. Cl. ..... 427/127; 427/131; 427/385.5; 427/388.4

[58] Field of Search ..... 427/131, 127, 388.4, 427/385.5

[56] References Cited

U.S. PATENT DOCUMENTS 3,398,011 8/1968 Neirotti et al. ..... 427/131
3,928,675 12/1975 Tieszen ..... 427/388.4
4,252,859 2/1981 Concannon et al. ..... 427/388.4
4,504,528 3/1985 Zucker et al. ..... 427/388.4
4,526,833 7/1985 Burguette et al. ..... 427/131
4,713,287 12/1987 Nishikawa et al. ..... 427/131
4,794,035 12/1988 Ishihara et al. ..... 427/131
4,828,924 5/1989 Shoji et al. ..... 427/128
5,069,967 12/1991 Yokoyama et al. ..... 427/131

FOREIGN PATENT DOCUMENTS 5760880 10/1983 Japan ..... 427/127

*Primary Examiner*—Michael Lusignan
*Assistant Examiner*—Diana L. Dudash
*Attorney, Agent, or Firm*—Antonelli, Terry Stout & Kraus

[57] ABSTRACT

A method of forming a lubricating film which comprises to apply an emulsion composed of a fluorinated polymer, a surfactant and a dispersing medium to a substrate and then dry the film, and a method of preparing a magnetic recording medium which comprises to apply the above method to a magnetic recording medium, are disclosed.

6 Claims, 1 Drawing Sheet

METHOD OF FORMING LUBRICATING FILM AND A METHOD OF PREPARING MAGNETIC RECORDING MEDIUM

BACKGROUND OF THE INVENTION

The present invention relates to a method of forming a lubricating film comprising fluorinated polymer and a method of preparing a magnetic recording medium as an application thereof.

So far the method of forming a lubricating film on a magnetic recording medium has been carried out, as described in Japanese Patent Application Kokai (Laid-Open) No. 59-107428 (1984), by using a flon solution of perfluoropolyether as lubricant, applying the solution to a magnetic recording medium by means of dipping, spin coating, spray coating or the like, and then drying it.

In the prior art as mentioned above, there has been a problem that for the flon solvent mainly Flon 113 or the like is used. Flon 113 is a solvent which is a subject of regulation for reason of environmental disruption, and hence it is necessary to develop an alternative solvent as early as possible. At present, however, no suitable solvent has been found, and this makes a serious problem.

SUMMARY OF THE INVENTION

The object of the present invention is to provide a method of forming a lubricating film using a solvent which has no problem of environmental disruption.

The second object of the present invention is to provide a method of preparing a magnetic recording medium as an application of the above forming method.

The present invention provides (1) a method of forming a lubricating film which comprises applying an emulsion composed of a fluorinated polymer, a surfactant and a dispersing medium to a substrate and then drying the film.

Furthermore, the present invention provides a method of preparing a magnetic recording medium which comprises to apply any of the above-mentioned lubricating film forming method to a magnetic recording medium.

DETAILED DESCRIPTION OF THE INVENTION

Figure 1:
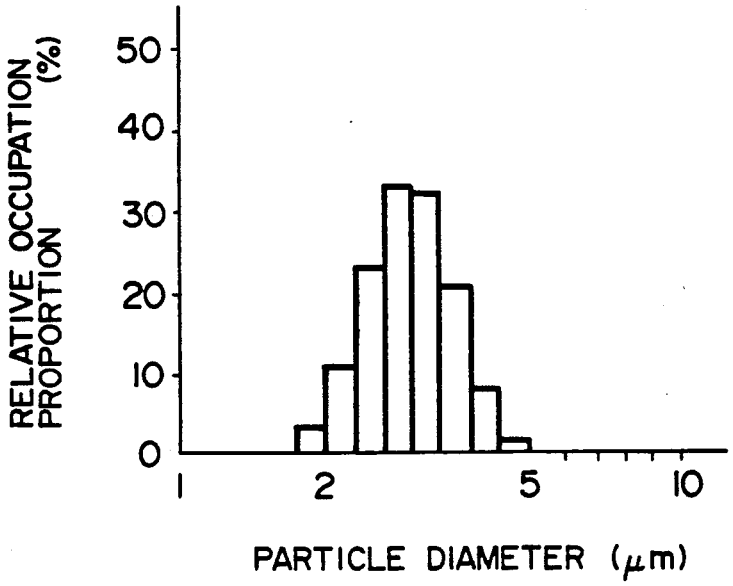
FIG. 1 is a graph representing particle size distribution of an emulsion prepared in Example 1 of the present invention.

In the present invention, it is preferred to use water for the dispersing medium. The lubricant of fluorinated polymer is combined with water through the medium of a surfactant to be used in a stably micronized (emulsified) state.

The preferred surfactants which are used in the present invention, include nonionic surfactants, particularly fluorocarbon polymer, polyoxyethylene alkyl ethers, polyoxyethylene alkyl phenol ethers, polyoxyethylene alkyl esters, sorbitan alkyl esters, polyoxyethylene sorbitan alkyl esters and the like. Besides, good results can be obtained with cationic and anionic surfactants also.

Regarding the fluorinated polymers in the present invention as a lubricant, preferably perfluoropolyether (PFPE) or PFPEs having various functional end groups are used. These polymers having molecular weights of at least 3000 are preferred.

For example, such PFPE includes the compounds represented by the following formula:

$$F-(CP(CF_3)CF_2O)_n-C_2F_5$$

in which n is a number from 11 to 49.

The functional group in PFPE having the functional groups include —COOH and other groups.

As emulsion comprising a fluorinated polymer, surfactant and dispersing medium preferably contains 1 to 10 parts by weight of the fluorinated polymer, 1 to 10 parts by weight of the surfactant and 10 to 1000 parts by weight of the dispersing medium. If such a formulation rate as above is exceeded, no emulsion having a suitable particle size can be obtained. Particularly, if the fluorinated polymer is present too much, the resulting viscosity is too high for the emulsion to be applied.

For the method to apply the emulsion to substrates, those typical application methods including dipping, spin coating, spray coating or the like can be employed.

For the drying method, such methods as (1) spin drying, (2) drying by spraying a rotated disk with a high pressure gas, (3) drying by spraying a rotated disk with hot air or (4) drying in a clean oven, are applied. The preferable thickness of lubricating film is of 1 to 100 nm, particularly of 1 to 30 nm.

When a fluorinated high polymer compound and water are simply mixed, they separate into two layers and remain as they are. If a surfactant stands between them, the hydrophilic groups of surfactant molecules join to water molecules and the hydrophobic groups thereof join to the high polymer compound molecules. Thus the high polymer compound is uniformly dispersed in the water to form an emulsion.

By selecting types and concentration of the surfactant it is possible to regulate the mean particle diameter of emulsion in the range of 0.1 to 500 μm. For example, the more the quantity of surfactant, the less the particle diameter of emulsion. In the present invention the most preferable mean particle diameter of emulsion is in the range of 0.1 to 10 μm. If an emulsion having a mean particle diameter in this range is applied to a substrate, the polymer uniformly adheres to the substrate, and the covering rate is improved. Thus a magnetic recording medium prepared according to the present invention will have an antislide strength equivalent to or higher than that of conventional products.

DESCRIPTION OF THE PREFERRED EMBODIMENTS

[EXAMPLE]

Hereinafter the present invention will be illustrated with examples.

EXAMPLE 1

500 g of water is put in a vessel. Under stirring 5 g of a fatty acid ester (trade name: Rheodol, manufactured by Kao K.K) as surfactant and 5 g of PFPE (trade name: Krytox FS/H, manufactured DuPont Company, U.S.A.) are added, mixed and stirred. Upon this if the mixture is stirred not enough, it makes the particle size larger and the particle size distribution broader. The resulting emulsion is subjected to supersonic waves for 10 minutes to form an emulsion comprising uniformly dispersed particles with even diameters, that is, an emulsion of sharp particle size distribution. A particle size distribution in this state is shown in FIG. 1.

The emulsion thus prepared was uniformly applied to the whole surface of a magnetic disk, and then heat-dried to form a lubricating film.

The covering rate of thus formed lubricating film was determined by the contact angle measuring method using n-hexadecane. The contact angle measuring method is a method in which n-hexadecane is dropped on a magnetic disk and the contact angle is measured.

$$C(\text{coating proportion}) = \frac{\cos\theta_0 - \cos\theta_1}{\cos\theta_0 - \cos\theta_s}$$

$\theta_0$: angle before applying lubricant $\theta_1$: angle after applying lubricant $\theta_s$: angle when completely covered.

Besides, the coating film strength of magnetic disk was measured by a method of spherical surface sliding strength. In the method of spherical surface sliding strength a sliding tip of slider is brought to contact with a disk, and the strength is measured by rotating the disk (the method is described in Proceedings of the Japan international tribology conference Nagoya, 1990, p. 1313). In either case the obtained results were equivalent to those of conventional methods (using organic flon solvents). The adhesion strength was determined by bringing a magnetic head contact with a disk to be measured, and pulling the magnetic disk with a tension gauge to measure the tensile strength. The values of adhesion strength measured by a adhesion tester were in the range of 5 to 6 g for conventional disks, whereas said values for those of the present invention were in the range of 3 to 4 g.

Further, some similar experiments were carried out using other PFPE products such as trade name Krytox 143AZ, Krytox 164S, Krytox 157FS (manufactured by DuPont Co., L.S.A.), trade name Fomblin Z-03, Fomblin Z-15, Fomblin Z-60 (manufactured by Monteflon Co., U.S.A.) and in any case almost the same results were obtained.

Besides, a similar experiment was carried out using a fatty acid ester with a trade name of Emasol (manufactured by Kao K.K.) and almost the same results were obtained.

EXAMPLE 2

Figure 2:
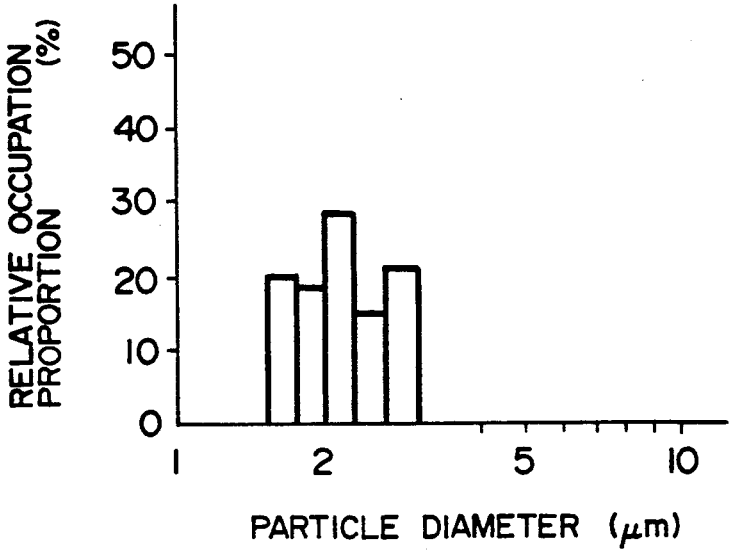
FIG. 2 is a graph representing particle size distribution of an emulsion prepared in Example 2 of the present invention.

100 g of water, 1.1 g of polyoxyethylene alkyl ether (trade name: Emarugen, manufactured by Kao K.K.) as surfactant and 1.9 g of PFPE (trade name: Krytox FS/H, manufactured by DuPont Co. U.S.A.) were used to form an emulsion in a similar manner to Example 1. The particle size distribution of this emulsion is shown in FIG. 2.

The emulsion was applied by spin coating to a magnetic disk and heat-dried to form a lubricating film. The coating proportion of lubricating film and the coating strength of magnetic disk were determined by the same way as Example 1. In the result either of these properties was improved by about 30% better than those of conventional ones. The adhesion strength was in the range of 3 to 4 g. This seems owing to that as compared with the particle diameter of about 5 to 10 μm when a lubricant was sprayed with a conventional flon solvent, the particle diameter of this emulsion is at most about ½ of above.

In another experiment using a polyoxyethylene alkyl ether (trade name: Furorado, manufactured by Sumitomo 3M Co.) almost the same result was obtained.

The above results are summarized in Table 1.

Although in the above examples the present invention was applied to magnetic disks, it also is evident that when applied to other substrates such as magnetic cards, magnetic tapes or the like, the present invention can be effective.

According to the present invention, a dispersing medium such as water is used instead of organic flon solvents, therefore there is no fear of environmental disruption and also a large reduction in production costs can be attained.

Besides, according to the present invention, a lubricating film can be formed on a substrate very uniformly and in addition with a good coating proportion. Thus the slide strength of magnetic recording medium prepared according to the present invention is equivalent to or higher than those of conventional ones, and the adhesion strength is decreased so effectively as to prevent the adhesion of magnetic head.

TABLE 1

| Item | | Coating proportion (%) | Spherical surface slide strength (k times) | Adhesion strength (g) |
|---|---|---|---|---|
| Prior art | Organic flon solvent | 70–75 | 10–15 | 5–6 |
| Example 1 | Krytox FS/H | 70–75 | 10–18 | 3–4 |
| | Krytox 143AZ | 70–78 | 10–15 | 3–4 |
| | Krytox 164S | 70–75 | 10–15 | 4–5 |
| | Krytox 157FS | 75–80 | 12–18 | 3–4 |
| | Fomblin Z-03 | 70–75 | 10–15 | 3–4 |
| | Fomblin Z-15 | 70–75 | 10–18 | 3–4 |
| | Fomblin Z-60 | 72–78 | 10–15 | 4–5 |
| | Emasol | 70–75 | 10–15 | 3–4 |
| Example 2 | Emarugen | 90–95 | 15–25 | 3–4 |
| | Frorado | 90–95 | 15–23 | 4–5 |

We claim:

1. A method of forming a lubricating film which comprises applying an emulsion comprising 1 to 10 parts by weight of a fluorinated polymer, 1 to 10 parts by weight of a surfactant and 10 to 1,000 parts by weight of water as a dispersing medium to a substrate and then drying the film; said fluorinated polymer being a perfluoropolyether represented by the following formula:

$$F-(CF(CF_3)CF_2O)_n-C_2H_5$$

wherein n is a number from 11 to 49 and the means particle diameter of the emulsion is in the range of 0.1 to 10 μm.

2. A method of forming a lubricating film according to claim 1, wherein said surfactant is a nonionic surfactant.

3. A method of forming a lubricating film according to claim 1, wherein said lubricating film after drying has a thickness of 1 to 100 nm.

4. A method of preparing a magnetic recording medium which comprises to apply the method of forming a lubricating film according to claim 1 to a magnetic recording medium.

5. A method of forming a lubricating film according to claim 1, wherein said surfactant is a nonionic surfactant said; said and said lubricating film after drying has a thickness of 1 to 100 nm.

6. A method of forming a lubricating film according to claim 5, wherein said perfluoropolyether has a molecular weight of at least 3000.

* * * * *